United States Patent [19]

Smith

[11] 4,368,544

[45] Jan. 18, 1983

[54] CONVERTIBLE NECKTIE STRUCTURE

[76] Inventor: Ellis L. Smith, 6410 Brentwood Stair Rd. #105, Fort Worth, Tex. 76112

[21] Appl. No.: 277,634

[22] Filed: Jun. 26, 1981

[51] Int. Cl.[3] ..... A41D 25/14; A41D 25/16

[52] U.S. Cl. ..... 2/153; 2/156

[58] Field of Search ..... 2/149, 150, 152 R, 152 A, 2/153, 155, 156

[56] References Cited

U.S. PATENT DOCUMENTS

| | | | |
|---|---|---|---|
| 556,135 | 3/1896 | Compton | 2/153 |
| 2,422,992 | 6/1947 | Taborski | 2/153 |

FOREIGN PATENT DOCUMENTS

| | | | |
|---|---|---|---|
| 232586 | 6/1944 | Switzerland | 2/153 |

*Primary Examiner*—Richard J. Scanlan, Jr.
*Attorney, Agent, or Firm*—Jim Peppers

[57] ABSTRACT

Discloses a convertible necktie structure having a triangular knot body defining a generally cylindrical socket extending into a first angle of the body and releasable strap connection elements extending from the other two angles of the body with a first fabric draped across a generally convex front of the body and around the two sides of the body which extend from the socket to each of the other two angles. A fabric retaining element defined by the body retains the fabric in draped position. A generally cylindrical plug fitted and latched into the socket grasps a necktie streamer provided of a second fabric to complete the appearance of a necktie formed of the first fabric and the second fabric. A retaining neck strap releasably connects to the strap connection elements. The fabric retainer elements are hooking pins defined by the body and hooked into the first fabric. The plug means may include a plug sleeve releasably connected into the socket and a tie streamer retainer bushing element grasping the tie streamer and latched into the plug sleeve. The strap connection elements respectively comprise a stem extended from each of the other two angles and terminated in a ball. The body is preferably provided of plastic material formed by pressure molding.

12 Claims, 17 Drawing Figures

FIG. 1
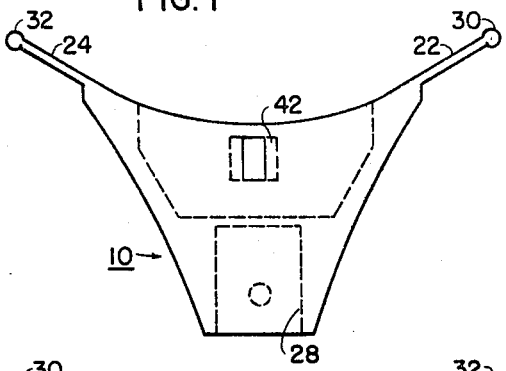
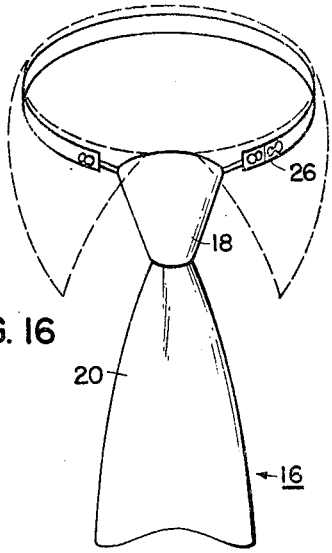
FIG. 16
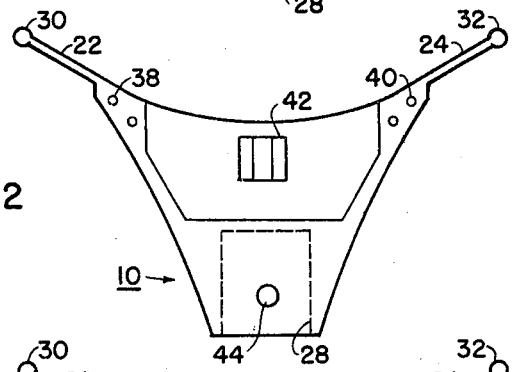
FIG. 2
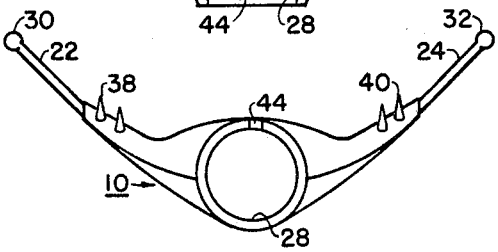
FIG. 3
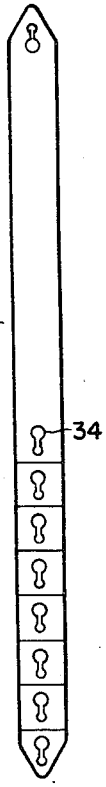
FIG. 10
FIG. 4
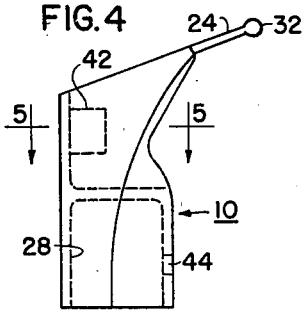
FIG. 5
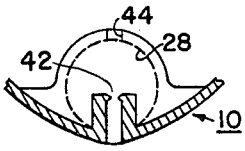
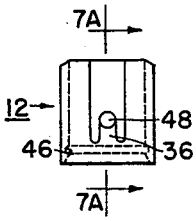
FIG. 6
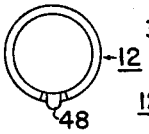
FIG. 7
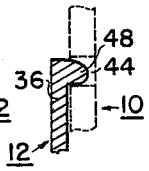
FIG. 7A
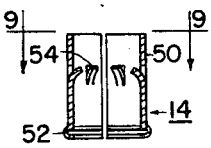
FIG. 8
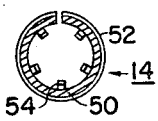
FIG. 9

FIG. 11
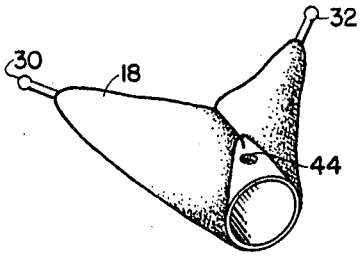
FIG. 13
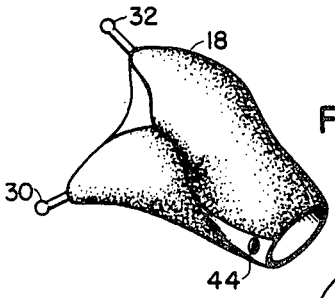
FIG. 12
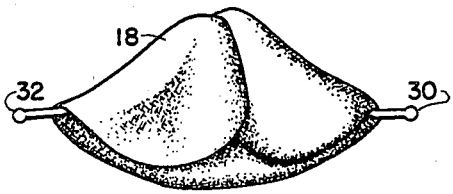
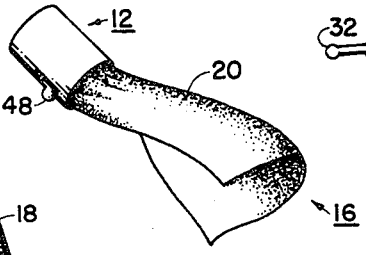
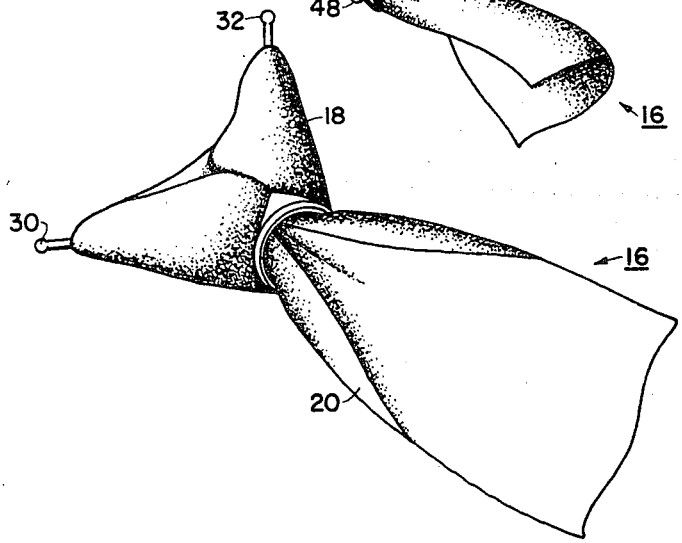
FIG. 14
FIG. 15
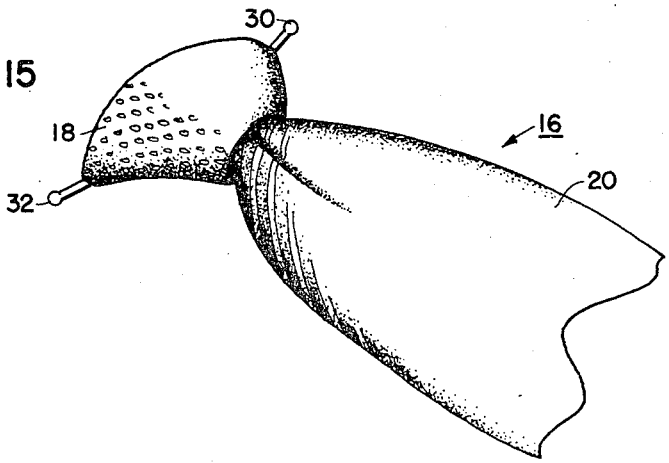

CONVERTIBLE NECKTIE STRUCTURE

This invention generally pertains to neckties or cravats as usually worn by men, and more particularly pertains to neckties having a "pre-tied" knot and additionally where different patterns of tie streamer fabric may be worn with different patterns of knot fabric.

BACKGROUND OF THE INVENTION

Over the past years, there have been a number of pre-tied neckties of various kinds available on the market which have continuing popularity.

These pre-tied neckties have variously been attached with (a) straps around the wearers neck, (b) with clips to clip the ties to the collars of a shirt, (c) with hooks to hook the tie knot into the neck of the shirt, and also (d) with studs and buttons for attachment of such a pre-tied necktie to the shirt collars.

The present invention is an improvement in that one pattern of fabric may be covered over a knot apparatus and a different pattern of fabric utilized in the tie streamer with the combination being readily changeable to suit the wearer.

The most pertinent prior art appears to be necktie structures such as shown in U.S. Pat. Nos. 1,972,906, 2,422,992, and 2,596,739.

U.S. Pat. No. 1,972,906 shows a necktie structure having a pre-formed knot and adapted to be attached to a shirt collar by means of a stud arrangement.

U.S. Pat. No. 2,422,992 shows a knot body in a pre-formed tie structure adapted to be supported within a shirt collar by means of side wings fitting underneath the down-turned portions of the collar.

U.S. Pat. No. 2,596,739 discloses a pre-formed knot adapted to be fashioned to the neck of a wearer by means of a strap attached to the pre-formed knot and also providing different tie streamers for a particular pre-formed knot body.

OBJECTS OF THE INVENTION

One object of the present invention is to provide a improved pre-formed knot body about which various tie materials may be easily draped and attached to cover the knot body and which will receive and retain a variety of tie streamers conveniently and positively.

Another object of the present invention is to provide a pre-formed tie structure attractive in appearance, convenient to fabricate, and convenient for the wearer to assemble and attach for use.

SUMMARY OF THE INVENTION

The foregoing and other objects and advantages are attained by a convertible necktie structure having a generally triangular knot body which defines a generally cylindrical socket extending into a first angle of the body and releasable strap connection elements extending from the other two angles of the body. A first fabric is draped across a generally convex front of the body and around the two sides of the body which extend from the socket to each of the other two angles. Fabric retaining hooks located along the rear side of the body retains the first fabric in draped position. A generally cylindrical plug element is releasably fitted into the socket which grasps a necktie streamer provided of a second fabric to complete the appearance of a necktie formed of said first fabric and said second fabric. A retaining neck strap is adapted to releasably connect to the strap connection elements. The plug element includes a plug sleeve releasably connected into the socket and a tie streamer retainer bushing means grasping said tie streamer and latched into the plug sleeve. The strap connection elements respectively comprise a stem extending from each of the other two angles and terminating in a ball or knob. The body is preferably provided of plastic material formed by pressure molding.

BRIEF DESCRIPTION OF THE DRAWING

FIG. 1 is the front view of a tie knot body;

FIG. 2 is the rear view of the tie knot body;

FIG. 3 is a plan view looking down on the tie knot body as shown in FIG. 1;

FIG. 4 is a side view of the tie knot body taken from the right of FIG. 3;

FIG. 5 is a sectional view of the tie knot body taken at the line 5—5 of FIG. 4;

FIG. 6 is a side view of a tie streamer plug which is adapted to plug into a socket shown in the tie knot body;

FIG. 7 is a plan view looking down on the tie streamer plug shown in FIG. 6;

FIG. 7A is a sectional view of a portion of the tie streamer plug taken at the line 7A—7A of FIG. 6;

FIG. 8 is a cross-sectional view taken along the axis of a tie streamer retainer sleeve adapted to be latched into the tie streamer plug shown in FIGS. 6 and 7;

FIG. 9 is a sectional view of the retainer sleeve as taken along the line 9—9 of FIG. 8;

FIG. 10 is a laid out view of a retainer strap adapted to support the tie knot body around the neck of a tie wearer;

FIG. 11 is a perspective view of the tie knot body draped with a tie knot fabric;

FIG. 12 is an end view of the tie knot body as draped with the tie knot fabric;

FIG. 13 is a perspective view of the draped tie knot body and a tie streamer fastened into the retainer sleeve of FIG. 9 and assembled into the tie streamer plug of FIG. 6 as ready for insertion into the draped tie body;

FIG. 14 is a perspective rear view of the tie streamer assembled and plugged into the draped tie knot body;

FIG. 15 is a perspective view of the front side of the assembled tie as shown in FIG. 14; and FIG. 16 illustrates the assembled tie as fastened about the neck of a wearer.

DESCRIPTION OF A PREFERRED EMBODIMENT

Referring first to FIGS. 1, 6, 9, 10, and 15, there is illustrated the convertible necktie structure of the present invention including a generally triangular knot body 10 into which is plugged a tie streamer plug member 12. The plug member 12 has inserted and retained therein a tie streamer retainer bushing 14 which grasps and retains a tie streamer or sash 16.

The knot body 10 is draped with a first knot fabric 18. The tie streamer 16 is formed of a second streamer fabric 20. The knot body 10 is provided with connection means 22 and 24 formed from the other two angles of the body to receive and be connected with an attachment strap 26.

The front and rear views of the knot body 10 are shown respectively in FIGS. 1 and 2. As shown, the knot body 10 is provided of generally triangular shape.

A generally cylindrical socket 28 is defined into a first lower angle of the body 10 as shown.

The connection means extending from the other two angles of the body 10 are formed as stems shown as terminating in balls or knobs 30 and 32 respectively. The knobs 30 and 32 are provided to fit into corresponding holes such as slotted hole 34 in a fastener strap 26 to retain the necktie around the neck of a wearer such as generally shown in FIG. 16.

As best shown in FIG. 3, the front of the knot body 10 is formed generally convex in shape to simulate the shape of an ordinary hand knotted necktie. At the upper rear of the body 10 disposed between the angles of the body 10 are means to retain a tie fabric draped about the knot such as barbs or pins 38 and 40.

As seen also in FIGS. 1, 2, 4, and 5, a receptacle clip 42 is formed above the socket. The purpose of receptacle clip as shown in FIG. 12 is to tuck in the ends of a tie knot fabric 18 which has been draped around the knot body 10.

Referring to FIGS. 1, 2, 3, 11, and 12, it is seen that the tie knot fabric 18 is draped about the two sides of the body 10 which extend from the socket 28 to each of the other two angles and is draped up over the top of the body 10 and across the pins 38 and 40 to be retained in a snugly draped position. The extra ends of the fabric are then tucked into the receptacle clip 42.

Defined in the side wall of the socket 28, as later described, is a latching hole 44 which is shown in FIGS. 1–5, and 11.

Shown in FIGS. 6, 7, and 7A is the generally cylindrical plug 12 which is adapted to fit into the socket 28 and carry the tie streamer 16. The plug member 12 is bevelled at its top to facilitate entry into the socket 28 and bevelled into its bottom end to facilitate entry of a retainer bushing 14, as later described. The plug 12 also has defined within its lower end a retainer groove 46.

The side of the plug 12 is longitudinally slotted with a portion of the side extending up into such slot and terminating in a latching ratchet dog 48. A portion of the side wall of the plug 12 extends up to the ratchet dog 48 and serves as a resilient tongue 36 which permits the dog to flex into the bore of the plug in a resilient manner.

When the plug 12 is plugged into the socket 28 of knot body 10, the ratchet dog 48 is flexed inwardly and slides along the interior wall of the socket 28 until it is allowed to spring outwardly into the latching hole 44 of the socket 28 and thereby latch the plug 12 into the body 10.

The plug 12 may be readily removed from the socket 28 by depressing the ratchet dog 48, as with the point of a ball point pen, and pulling the plug from the socket while the ratchet dog is in depressed position. Thus, the plug 12 may be readily inserted, latched, and removed, as desired.

The retainer bushing 14 such as shown in FIGS. 8 and 9, may be formed of a thin flexible metal shell 50, which is similar to the metal sleeve which retains an eraser on a pencil. The shell 50 is split down in its side for flexibility and has a latching ferrule 52 rolled around the bottom end and adapted to latch within the latching groove 46 of the plug 12. The shell 50 is split down its side so that, in addition to being resilient, it may be opened up slightly. The shell 50 has impressed into its side wall a plurality of grasping barbs or projections 54.

The tie streamer or sash 16 is appropriately folded to give a creased appearance such as shown in FIG. 15 and inserted into the shell 50 of the bushing 14. The shell 50 is then crimped closed and the barbs 54 are thereby imbedded into the streamer fabric.

The bushing member 14, with the fabric grasped within the bushing by the barbs 54, is then inserted into the plug member 12 until the latch ferrule 52 is snapped into the latching groove 46. The plug member is then complete and ready for insertion into the socket 28 to latch the ratchet dog 48 into the latch hole 44 when desired.

The strap 36 is then attached to the knot body 10 by slipping or passing knobs 30 and 32 through a respective hole 34 and pulling the strap in tension to pull the ball 32 into retention within the slot.

It is to be noted that all the surfaces of the knot body 10 as shown in FIGS. 1–5 and the plug member 12 as shown in FIGS. 6 and 7 are preferably sloped and pitched in a manner facilitating the forming of these members by injection pressure molding. The members 10 and 12 may be provided of any plastic now used commercially which is sturdy and readily moldable. The strap attachments 22 and 24 may be of the same plastic or inserted metal pieces.

It may be seen that the assembly as shown and described herein may be marketed as a "kit" including the knot body 10, one to several plug members 12, retainer bushings 14, and the attachment strap 26. The purchaser of such a kit may then take any of his existing ties and cut the same to form draping knot fabrics 18 and fabrics 20 for streamers 16, as desired, with any combination of patterns, colors, and materials.

Also, the convertible tie may be marketed as shown with the assembly of body 10, the plug member 12, the bushing 14, and the strap 26 along with a variety of knot fabrics and streamer fabrics for matched or mixed knots and streamers.

It will become apparent to those skilled in the art that various modifications and additions may be made to the embodiment as herein disclosed, all without departing from the spirit of the invention as set forth in the appended claims.

I claim:

1. In an article of manufacture adapted to receive and retain a first fabric draped to appear as a necktie knot and to receive and retain a second fabric suspended to appear as a necktie streamer with said streamer and said knot being readily changed respective to one another, the combination comprising:

(a) a general triangular knot body defining (1) a generally convex front side, (2) a generally cylindrical socket extending into a first angle of said body, (3) strap connection means disposed at the other two angles of said body for releasably connecting a neck strap to said body, and (4) fabric retaining means defined on the rear of said body along the two sides extending from said first angle respectively to each of said other two angles;

(b) said body being adapted to receive said first fabric draped across said front side, around said two sides and said retaining means in draped position to appear as a necktie knot;

(c) a hollow generally cylindrical plug means releasably fitted into said socket;

(d) detent latching means releasably latching said plug means within said socket; and (e) said plug means including grasping means having internal barbs adapted to grasp said second fabric in suspended relationship to appear as a necktie streamer.

2. The article of claim 13 wherein said fabric retainer means are hooks defined by said body and adapted to hook into said first fabric.

3. The article of claim 2 further including receptacle means defined by said body between said other two angles and adapted to tuck in the ends of said first fabric as retained by said hooks.

4. The article of claim 1 wherein said grasping means comprises a cylindrical fabric retainer bushing means including said internal barbs latched into said plug means and adapted to grasp and retain said second fabric.

5. The article of claim 1 wherein said strap connection means respectively comprises a stem extending from each of said other two angles and terminating in a knob.

6. The article of claim 5 further including a necktie strap adapted to receive and retain said knob when said strap is in use.

7. The article of claim 1 wherein said body is provided of plastic material formed by pressure molding.

8. The article of claim 1 further including said first fabric and said second fabric in combination.

9. The article of claim 1 wherein said detent latching means comprises a latching dog member resiliently and removably supported within said socket.

10. The article of claim 8 wherein said retainer bushing means comprises a sleeve having inwardly directed barbs for grasping said tie streamer and a resilient detent for latching said bushing means within said plug means.

11. The article of claim 10 wherein said detent latching means comprises a latching dog member resiliently and removably supported within said socket.

12. The article of claim 11 wherein said strap connection means respectively comprises a stem extending from each of said other two angles and terminating in a ball.

* * * * *